US006250029B1

(12) United States Patent
Jeffers et al.

(10) Patent No.: US 6,250,029 B1
(45) Date of Patent: Jun. 26, 2001

(54) PANEL WALL CONSTRUCTION

(75) Inventors: Robert Eugene Jeffers, Ada; Karl Jahn Mead, Grand Rapids; Douglas Bruce MacDonald, Caledonia, all of MI (US); Charles Anthony Seiber, Atherton, CA (US)

(73) Assignee: Steelcase Development Inc., Caledonia, MI (US)

( * ) Notice: Subject to any disclaimer, the term of this patent is extended or adjusted under 35 U.S.C. 154(b) by 0 days.

(21) Appl. No.: 09/407,185

(22) Filed: Sep. 27, 1999

Related U.S. Application Data

(63) Continuation of application No. 08/866,702, filed on May 30, 1997, now abandoned.

(51) Int. Cl.[7] ..... E04B 2/74; H02G 3/30

(52) U.S. Cl. ..... 52/220.7; 52/239; 52/481.2; 52/775; 52/585.1

(58) Field of Search ..... 52/238.1, 239, 52/243, 220.7, 481.2, 775, 585.1, 582.2

(56) References Cited

U.S. PATENT DOCUMENTS

| | | |
|---|---|---|
| 1,417,664 | 5/1922 | Garlinghouse . |
| 1,820,123 | 8/1931 | Donovan . |
| 1,981,240 | 11/1934 | NcNeil . |

(List continued on next page.)

FOREIGN PATENT DOCUMENTS

| | | |
|---|---|---|
| 835 646 | 4/1952 | (DE) . |
| 2 249 914 | 4/1974 | (DE) . |
| 24 37 400 A1 | 2/1976 | (DE) . |
| 2741460 | 3/1979 | (DE) . |
| 28 35 952 A1 | 3/1979 | (DE) . |
| 2823236 | 11/1979 | (DE) . |
| 50241 | 4/1982 | (EP) . |
| 0 348 268 A1 | 12/1989 | (EP) . |
| 629756 | 12/1994 | (EP) . |
| 1 001 293 | 2/1952 | (FR) . |
| 1 154 245 | 4/1958 | (FR) . |
| 2 273 123 | 12/1975 | (FR) . |
| 700465 | 12/1953 | (GB) . |
| 2097836 | 11/1982 | (GB) . |
| 2 102 869 | 2/1983 | (GB) . |
| 2174733 | 11/1986 | (GB) . |
| 86407 | 5/1936 | (SE) . |
| 600280 | 3/1978 | (SU) . |
| 1294947 | 3/1987 | (SU) . |
| WO 96/36777 | 11/1996 | (WO) . |

OTHER PUBLICATIONS

Steelcase, "Cable Facts", 1993.
Steelcase, "New Data/Telecom Connector Housings", 1988.
Structural Concepts Corporation, "Electronic Technical Furniture Information Processing Stations".
Artec, "Furniture Systems Installation".
Haworth, "All about Premise", Dec. 1996, pp. 2–186.
Steelcase® "Elective Elements® Cable Management Panel SPB89", 1989, pp. 1–2 and 4.
Stow & Davis® "Elective Elements Cable Management Panel Installation SP89", 1989.
Steelcase "Adding Grommet Holes To Standard Elective Elements Surface, Installation Directions", Jan. 31, 1989.
Structural Concepts Corporation, "Electronic Technical Furniture General Product Price List", May 1, 1983.

*Primary Examiner*—Laura A. Callo
(74) *Attorney, Agent, or Firm*—Foley & Lardner

(57) ABSTRACT

A partition wall system providing for lay-in of cables, includes a plurality of interconnected panel sections. Each panel section has a base surface and a plurality of protrusions extending from the base surface and a plurality of covering skins. At least one of the covering skins is attached to each of the panel sections so that a passage is formed between the covering skin and the base surface of the panel section to allow the cables to travel through each panel section and between interconnected panel sections.

42 Claims, 13 Drawing Sheets

U.S. PATENT DOCUMENTS

| | | | |
|---|---|---|---|
| 2,039,601 | | 5/1936 | London . |
| 2,076,472 | | 4/1937 | London . |
| 2,132,032 | | 10/1938 | Jacobsen . |
| 2,164,137 | | 6/1939 | London . |
| 2,241,338 | | 5/1941 | Balduf . |
| 2,803,858 | | 8/1957 | Rader . |
| 2,991,855 | | 7/1961 | Buell et al. . |
| 3,037,593 | | 6/1962 | Webster . |
| 3,065,575 | | 11/1962 | Ray . |
| 3,312,025 | | 4/1967 | Deakins . |
| 3,324,615 | | 6/1967 | Zinn . |
| 3,324,617 | | 6/1967 | Knight et al. . |
| 3,327,440 | | 6/1967 | Watkins . |
| 3,534,463 | | 10/1970 | Molin et al. . |
| 3,633,327 | | 1/1972 | Klingensmith et al. . |
| 3,686,805 | | 8/1972 | Pofferi . |
| 3,715,948 | | 2/1973 | Liepings . |
| 3,759,001 | | 9/1973 | Judkins et al. . |
| 3,802,146 | | 4/1974 | Tacke et al. . |
| 3,863,412 | | 2/1975 | Bodycomb et al. . |
| 3,925,948 | | 12/1975 | Sauer et al. . |
| 3,939,620 | | 2/1976 | Bero . |
| 3,982,370 | | 9/1976 | Buffington . |
| 4,031,675 | | 6/1977 | Roberts et al. . |
| 4,037,379 | | 7/1977 | Ozanne . |
| 4,090,335 | | 5/1978 | Curatolo . |
| 4,121,645 | | 10/1978 | Behr . |
| 4,170,858 | | 10/1979 | Walker . |
| 4,224,769 | | 9/1980 | Ball et al. . |
| 4,351,870 | | 9/1982 | English, Jr. . |
| 4,413,458 | | 11/1983 | Ting . |
| 4,423,573 | | 1/1984 | Omholt et al. . |
| 4,439,960 | | 4/1984 | Jenkins . |
| 4,450,658 | | 5/1984 | Legeal . |
| 4,567,698 | | 2/1986 | Morrison . |
| 4,619,486 | | 10/1986 | Hannah et al. . |
| 4,716,699 | | 1/1988 | Crossman et al. . |
| 4,783,941 | | 11/1988 | Loper et al. . |
| 4,821,787 | | 4/1989 | Swanson . |
| 4,833,848 | | 5/1989 | Guerin . |
| 4,905,428 | | 3/1990 | Sykes . |
| 4,944,122 | | 7/1990 | Wendt . |
| 5,038,534 | | 8/1991 | Pollock . |
| 5,038,539 | | 8/1991 | Kelley et al. . |
| 5,042,213 | | 8/1991 | Menchetti et al. . |
| 5,062,246 | | 11/1991 | Sykes . |
| 5,117,599 | | 6/1992 | Voss . |
| 5,134,826 | | 8/1992 | La Roche et al. . |
| 5,165,213 | | 11/1992 | Finch et al. . |
| 5,175,969 | | 1/1993 | Knauf et al. . |
| 5,177,917 | | 1/1993 | del Castillo Von Haucke . |
| 5,197,246 | | 3/1993 | Hill . |
| 5,277,006 | | 1/1994 | Ruster . |
| 5,309,686 | | 5/1994 | Underwood et al. . |
| 5,341,615 | | 8/1994 | Hodges et al. . |
| 5,377,466 | | 1/1995 | Insalaco et al. . |
| 5,379,561 | | 1/1995 | Saito . |
| 5,383,313 | | 1/1995 | Deeke et al. . |
| 5,394,658 | | 3/1995 | Schreiner et al. . |
| 5,399,406 | | 3/1995 | Matsuo et al. . |
| 5,406,760 | | 4/1995 | Edwards . |
| 5,426,904 | | 6/1995 | Gilmore . |
| 5,473,851 | | 12/1995 | Northrup, Jr. . |
| 5,543,204 | | 8/1996 | Ray . |
| 5,561,958 | | 10/1996 | Clement et al. . |
| 5,606,919 | | 3/1997 | Fox et al. . |
| 5,768,845 | | 6/1998 | Beaulieu et al. . |
| 5,804,763 | | 9/1998 | Smeenge . |
| 5,813,178 | * | 9/1998 | Edwards ..... 52/239 |
| 5,822,935 | | 10/1998 | Mitchell et al. . |
| 5,826,385 | * | 10/1998 | Dykstra et al. ..... 52/220.7 |
| 5,913,787 | | 6/1999 | Edwards . |
| 5,930,960 | | 8/1999 | Konnerth . |
| 6,021,613 | * | 2/2000 | Reuter et al. ..... 52/241 |
| 6,023,893 | * | 2/2000 | Tanaka ..... 52/220.7 |
| 6,052,958 | * | 4/2000 | Miedema et al. ..... 52/239 X |

* cited by examiner

FIGURE 8
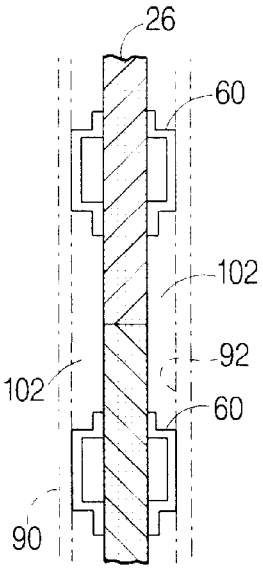
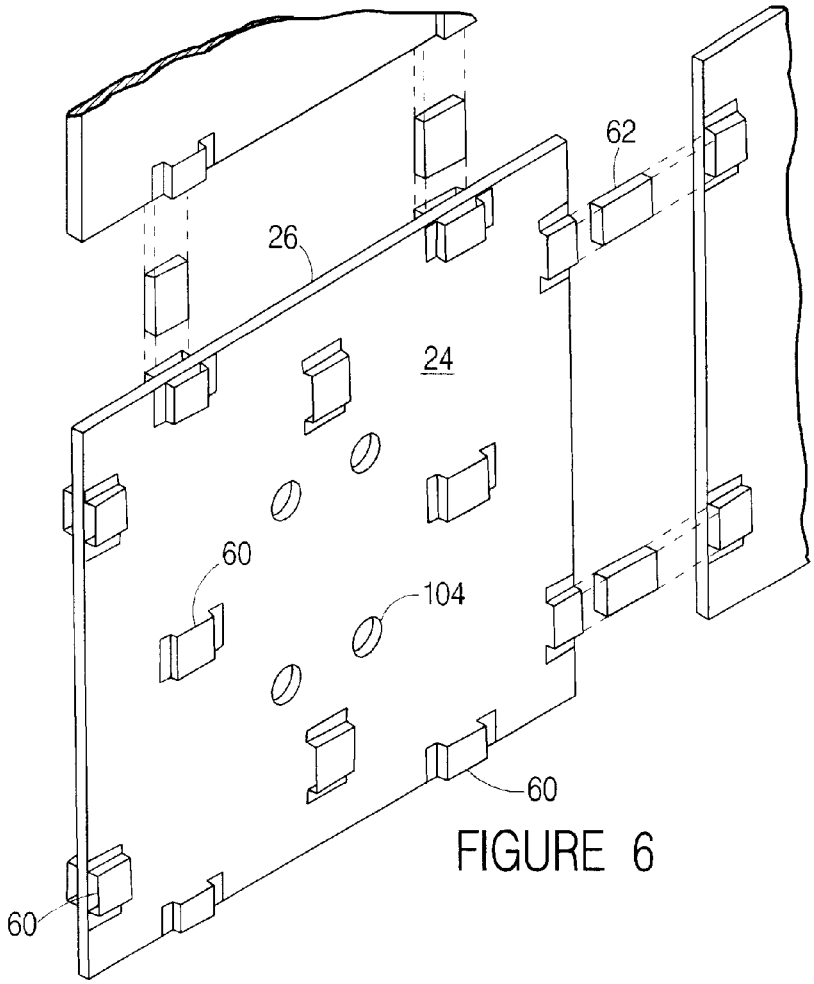
FIGURE 6
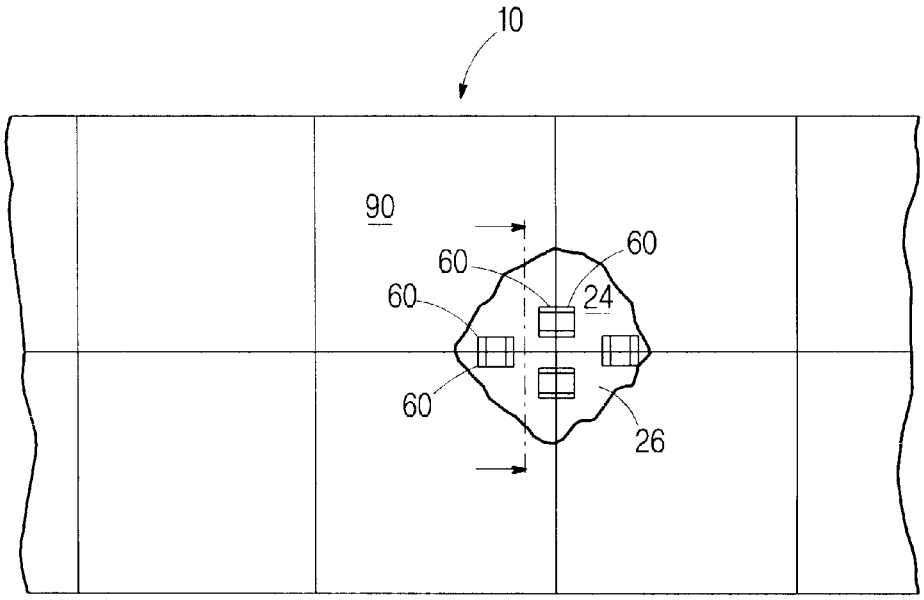
FIGURE 7

FIGURE 22
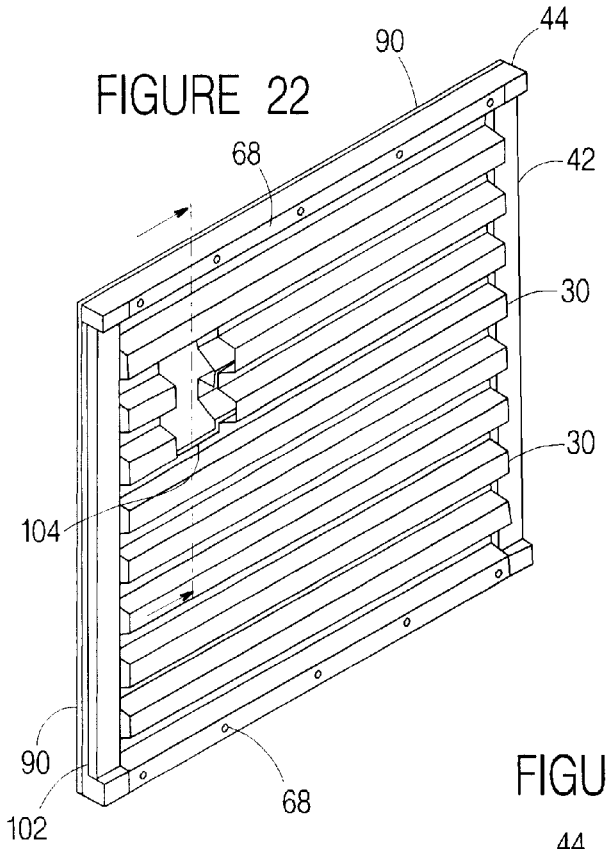
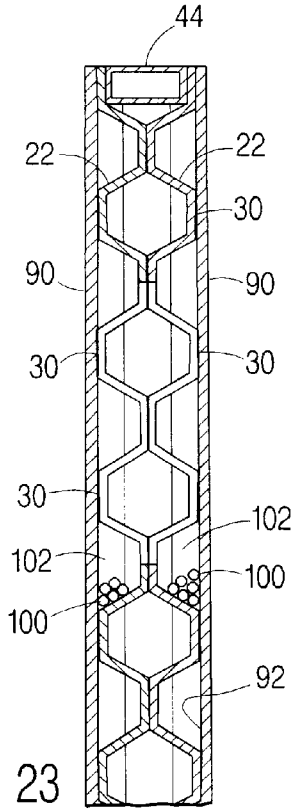
FIGURE 23
FIGURE 24
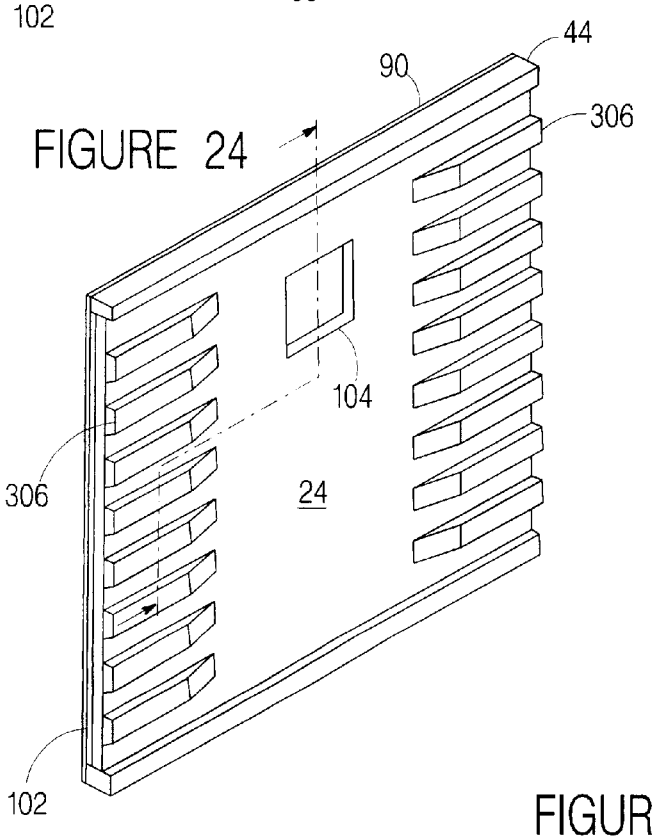
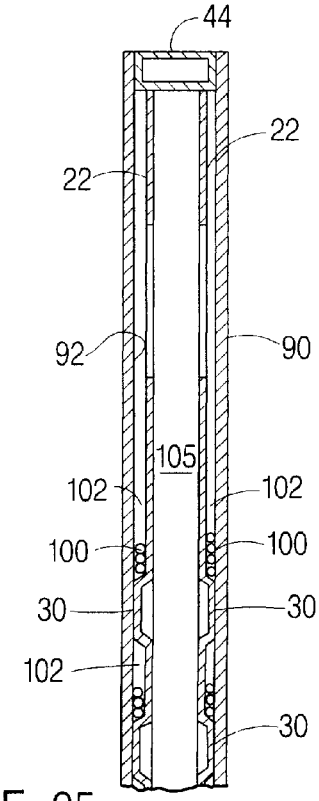
FIGURE 25

PANEL WALL CONSTRUCTION

RELATED APPLICATIONS

The present application is a continuation of U.S. patent application Ser. No. 08/866,702, titled "PANEL WALL CONSTRUCTION", filed on May 30, 1997, now abandoned incorporated by reference herein. The present application is also related to the following U.S. patent applications: Ser. No. 08/866,699, titled "PANEL WALL CONSTRUCTION", filed on May 30, 1997 now U.S. Pat. No. 6,158,178; Ser. No. 09/260,951, titled "PANEL WALL CONSTRUCTION", filed on Mar. 2, 1999 now pending; and Ser. No. 09/260,783, titled "PANEL WALL CONSTRUCTION", filed on Mar. 2, 1999 now U.S. Pat. No. 6,189,270.

FIELD OF THE INVENTION

The present invention relates to a panel wall construction for a partition wall system. In particular, the present invention relates to a construction of a panel section that provides for improved cable management and lay-in capability in the horizontal and vertical directions within the partition wall system.

BACKGROUND OF THE INVENTION

It is well-known to divide interior space within an office environment or the like by employing a partition wall system constructed of interconnected panel sections. Systems of this type are commercially available from various sources including the assignee of the present application and have been described in promotional and related literature for products sold under the name Series 9000, Context, Montage and in various U.S. patents, such as U.S. Pat. No. 5,406,760, U.S. Pat. No. 5,394,658 and U.S. Pat. No. 4,224,769, which materials are hereby incorporated by reference. Such known partition wall systems not only can provide for efficient space division and office worker privacy but also for flexibility in layout and arrangement, as well as desirable aesthetics.

It has become increasingly important to provide for electrical and data (including telephony and computer network) connectivity to equipment installed within the various spaces provided by the partition wall system (and used by office workers therein). Ordinarily, such equipment is connected and networked through various power and data cables and wires, which may result in the accumulation of a plurality of such cables and wires to be routed into, through and within the space. (For a description of workplace wiring and cabling, see for example, the Steelcase Cable Facts guidebook (S372 dated June 1993), which is incorporated by reference herein.) As a result of the proliferation of equipment to be connected it has become increasingly necessary to manage the accumulation of cables and wires more efficiently. Specifically, it has become desirable to provide that such cables and wires be "hidden" or maintained out of view by the partition wall system, and yet be readily accessible to the corresponding equipment.

As a result, partition wall systems, for example, as disclosed in U.S. Pat. No. 5,341,615, which is incorporated by reference herein, have been constructed with cable management capability. Typically, the cable management capability is in the manner of cable troughs or defined tracks at a particular horizontal level or at a particular vertical position on or adjacent to the interconnected panel sections (i.e. within or between the panel sections at particular horizontal positions). See exemplary U.S. Pat. No. 5,277,006, which is incorporated by reference herein. It is also known to provide as an attachment or extension to the panel section a horizontal "raceway" (i.e. a track or conduit at or near the floor) or "beltway" (i.e. a track or conduit at or near the worksurface level) or the like through which cables may pass continuously from panel section to panel section as comprise the partition wall system. (Like tracks or conduits are also used for vertical cable routing.) However, the use of such attachments (which must be mounted to the panel sections) tends to add to the complexity and cost of the partition wall system (and its constituent parts and assemblies) as well as to the time and cost of assembly of the partition wall system in the office environment. Moreover, such "raceway" or "beltway" arrangements do not flexibly provide for horizontal and vertical cable or wire lay-in insofar as the cable passages are essentially pre-defined in either a horizontal or vertical direction. Furthermore, special equipment (e.g. mounting hardware, etc.) is sometimes required in such existing systems to pass cables or wires along between adjoining panel sections of the partition wall system, which further can adversely affect cost and flexibility.

Accordingly, it would be advantageous to provide for the construction of a panel section in a partition wall system that readily provides for flexible cable management. It would also be advantageous to provide for a panel section of a relatively simple construction that provides for relative ease of installation and of cable lay-in during assembly of the partition wall system. It would further be advantageous to provide for a panel section that is suitable for low-cost fabrication and can be used with a wide variety of covering skins and in a wide range of applications and installations of partition wall systems.

SUMMARY OF THE INVENTION

The present invention relates to a partition wall system providing for lay-in of cables. The partition wall system includes a plurality of interconnected panel sections, each panel section having a base surface and a plurality of protrusions extending from the base surface. The partition wall system also includes a plurality of covering skins. At least one of the covering skins is attached to each of the panel sections so that a passage is formed between the covering skin and the base surface of the panel section to allow the cables to travel between interconnected panel sections and through each panel section.

DESCRIPTION OF THE DRAWINGS

FIGS. 5 and 6 are fragmentary exploded perspective views of the partition wall system constructed of interconnected panel sections (showing an exemplary cable management arrangement in FIG. 5) according to alternative embodiments of the present invention.

FIG. 7 is an elevation view of the front of a partition wall system showing panel sections according to an alternative embodiment of the present invention.

FIG. 8 is a fragmentary sectional side view of the partition wall system of FIG. 7 showing the interconnection of panel sections.

FIG. 22 is a perspective view of a panel section (with one covering skin attached) according to an alternative embodiment of the present invention.

FIG. 23 is a sectional view of the panel section of FIG. 22 (with both covering skins attached) also showing an exemplary cable management arrangement.

FIG. 24 is a perspective view of a panel section (with one covering skin attached) according to an alternative embodiment of the present invention.

FIG. 25 is a sectional view of the panel section of FIG. 24 (with both covering skins attached) also showing an exemplary cable management arrangement.

DETAILED DESCRIPTION OF THE PREFERRED EMBODIMENTS

Figure 1:
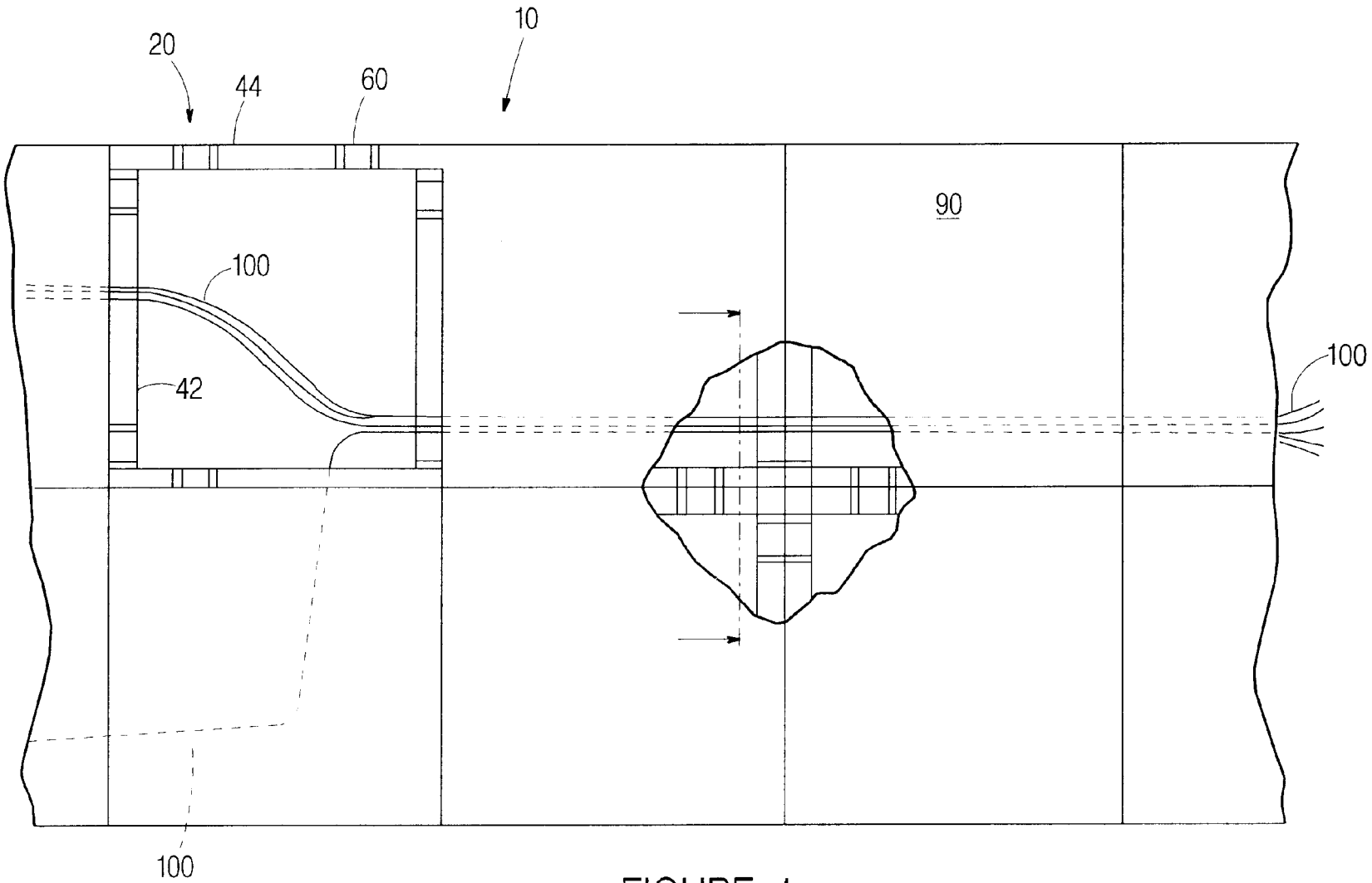
FIG. 1 is an elevation view of the front of a partition wall system showing panel sections and exemplary cable management arrangement (showing cables passing therethrough) according to a preferred embodiment of the present invention.

Referring to FIG. 1, a partition wall system 10 is shown according to a preferred embodiment of the present invention. Partition wall system 10 includes a plurality of interconnected panel sections 20 having covering skins 90 (some are not shown). As shown in the portion of FIG. 1 that is broken away, and in the panel section 20 where the covering skin 90 is not shown, cables (shown as wires 100) pass through partition wall system 10 through and between interconnected panel sections 20. Cables 100 provide electrical and data connections to and between various types of equipment (such as electrical appliances, lighting, telephony, computers and peripherals, etc.) that would be present in or associated with interior spaces created by the partition wall system 10. As shown, partition wall system 10 provides for a flexible cable management arrangement wherein cables 100 may travel in horizontal, vertical and diagonal directions along both sides of and between panel sections 20. (Cables 100 running behind covering skins 90 are shown in phantom lines.)

Figure 2:
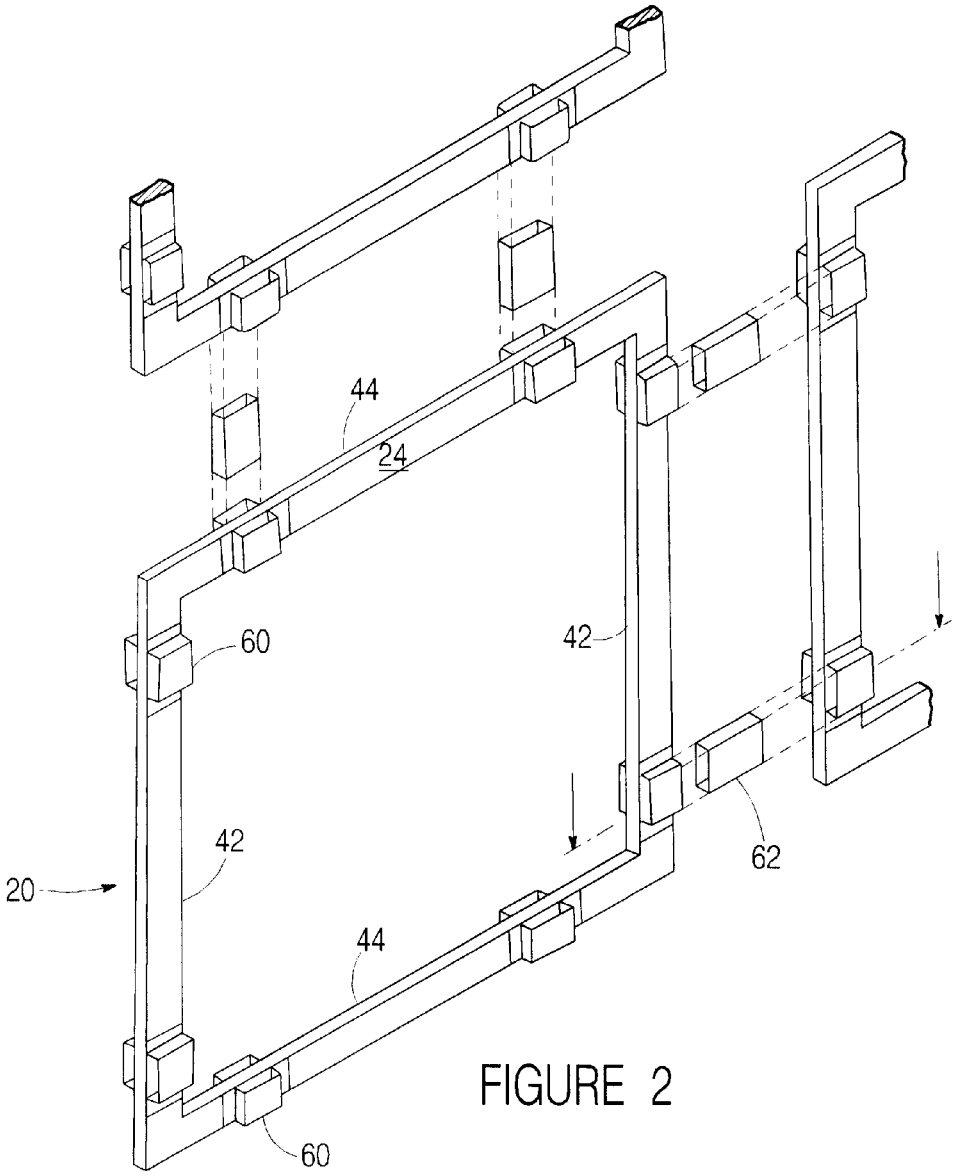
FIG. 2 is a fragmentary exploded perspective view of a partition wall system constructed of interconnected panel sections (shown without covering skins) according to a preferred embodiment of the present invention.

FIG. 2 shows a panel section 20 (without covering skins) as well as the interconnection of adjacent panel sections (shown partially) according to a particularly preferred embodiment. Panel section 20 is of a type shown in FIG. 1 and includes a "picture frame" structure formed of vertical posts 42 and horizontal beams 44, shown as rectangular metal tubes which are attached (i.e. by welding) to form a rigid orthogonal frame. Stand-offs or brackets (shown as channels 60) are mounted to the frame at two positions along each vertical post 42 and at two positions along each horizontal beam 44. Linking members (shown as rectangular block links 62) are used to couple adjacent brackets 60 to interconnect adjacent panel sections 20. As is illustrated in the detail shown in FIG. 3, links 62 span across interconnected panel sections 20 and can be secured within brackets 60 by fasteners (shown as mounting screws 68). According to a preferred embodiment, brackets 60 are formed into the appropriate shape (e.g. an open bracket) from metal strips and attached at lateral flanges (i.e. by welding or fasteners or the like) to the base surface 24 of the corresponding vertical post 42 or horizontal beam 44; links 62 as shown are metal tubes of a sufficient size and shape to fit within the passage formed when brackets 60 are attached to the frame.

As is evident, according to alternative embodiments, the arrangement and number of brackets employed in the construction of a panel section can be varied depending upon design considerations that relate to the purposes that the brackets are called upon to accomplish in the partition wall system. Furthermore, while a generally orthogonal shape (with flanges or tabs) is shown for brackets 60, and may be a particularly preferred shape, a wide variety of other shapes may be employed according to alternative embodiments to provide the stand-off function, and a wide variety of materials (such as metals or plastics) can be used.

Figure 3:
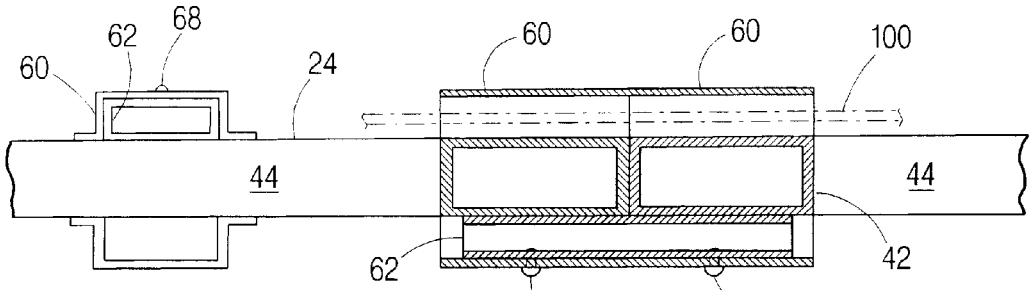
FIG. 3 is a fragmentary sectional top plan view of the partition wall system of FIG. 2 showing a detail of the interconnection of panel sections as well as a cable management arrangement.
Figure 4:
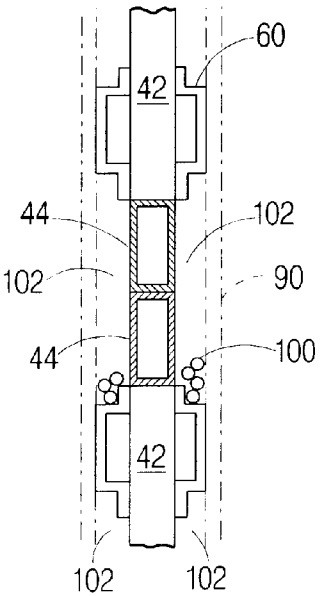
FIG. 4 is fragmentary sectional elevation view of the side of the partition wall system of FIG. 1 showing a detail of the interconnection of panel sections as well as a cable management arrangement.

As illustrated in FIGS. 3 and 4, one purpose served by brackets 60 according to any preferred embodiment is the creation of a space 102 between the base surface 24 of the panel section 20 and the inner surface (wall 92) of the covering skins 90. As evident from FIGS. 1, 3 and 4, space 102 creates an at least partially contiguous passage for cables 100 within and between interconnected panel sections 20, which passage 102 allows for flexible cable management and convenient cable lay-in capability. As shown, passage 102 is created on each side of the frame of panel section 20. According to any preferred embodiment, these cable passages 102 continue from one panel section to the adjacent panel section to provide a continuous cable lay-in capability throughout the partition wall system, regardless of how the panel sections are physically interconnected.

Figure 11:
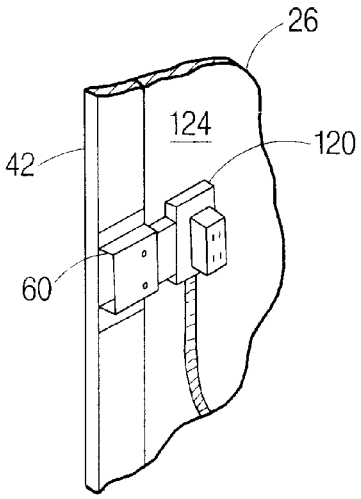
FIGS. 11 and 12 are fragmentary perspective and front views of a panel section providing for an external electrical outlet according to an alternative embodiment of the present invention.
Figure 12:
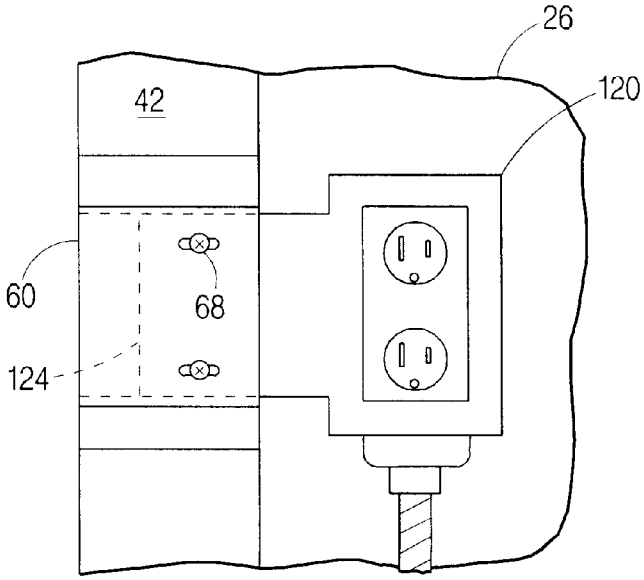

FIGS. 11 and 12 show another purpose for brackets 60. Brackets 60 can also be employed to attach an accessory (shown as a utility block 120) to panel section 20. Accessory (electrical outlet) 120 has a corresponding mounting structure 124 that is attached within bracket 60 by fasteners or the like (two securing screws 68 are shown). Brackets may also provide for attachment of a wide variety of other accessories that may be used in connection with the partition wall system, such as electrical or lighting switches, network equipment, telephony equipment, sensors, or the like.

Figure 30:
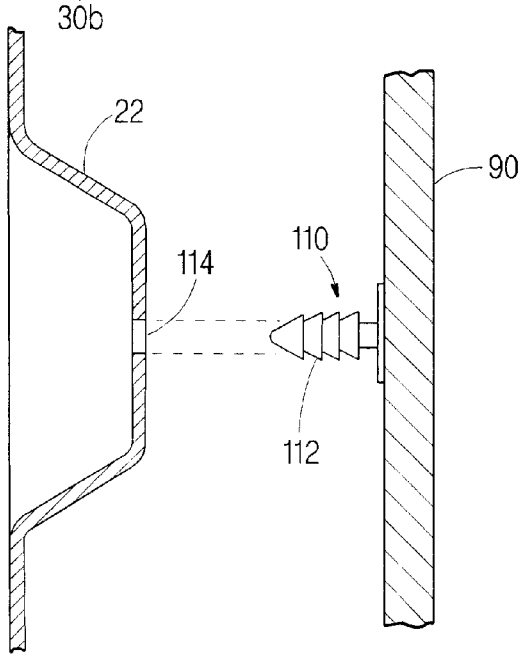
FIGS. 30 and 31 are fragmentary side views of the interconnection of a covering skin to a panel section according to a preferred embodiment of the present invention.
Figure 31:
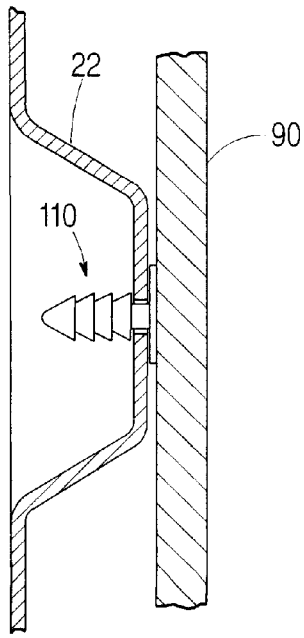

As is evident from FIGS. 4 and 8, brackets 60 also provide a mounting surface for covering skins 90 (shown in phantom lines) on each side of the panel section 20. As is known to those of skill in the art who review this disclosure, there are a wide variety of arrangements for mounting covering skins to a panel section 20, such as hooks or other fasteners (not shown). Refer to FIGS. 30 and 31 for exemplary arrangements by which covering skins 90 can be mounted to panel sections 20 according to other embodiments of the partition wall system. The disclosure of exemplary embodiments is not intended to limit the scope of the present invention, as other mounting arrangements are intended to be within such scope.

Referring to FIGS. 5 through 10, alternative embodiments of the partition wall system 10 are shown where the panel section 20 includes a frame that is made of a solid core 26 to which brackets 60 are attached (i.e. by fasteners or other mounting). Brackets 60 extend from a base surface 24 of panel sections 20 to form an at least partially uninterrupted and contiguous space 102 between base surface 24 of panel sections 20 and the inner surface (wall 92) of covering skin 90. As is generally evident from these FIGURES, space 102 defines a passage for cables 100 (i.e. paths through contiguous space) at least in the horizontal direction (and also in vertical and diagonal orientations according to certain embodiments) not only within a particular panel section but also between and across interconnected panel sections.

Figure 5:
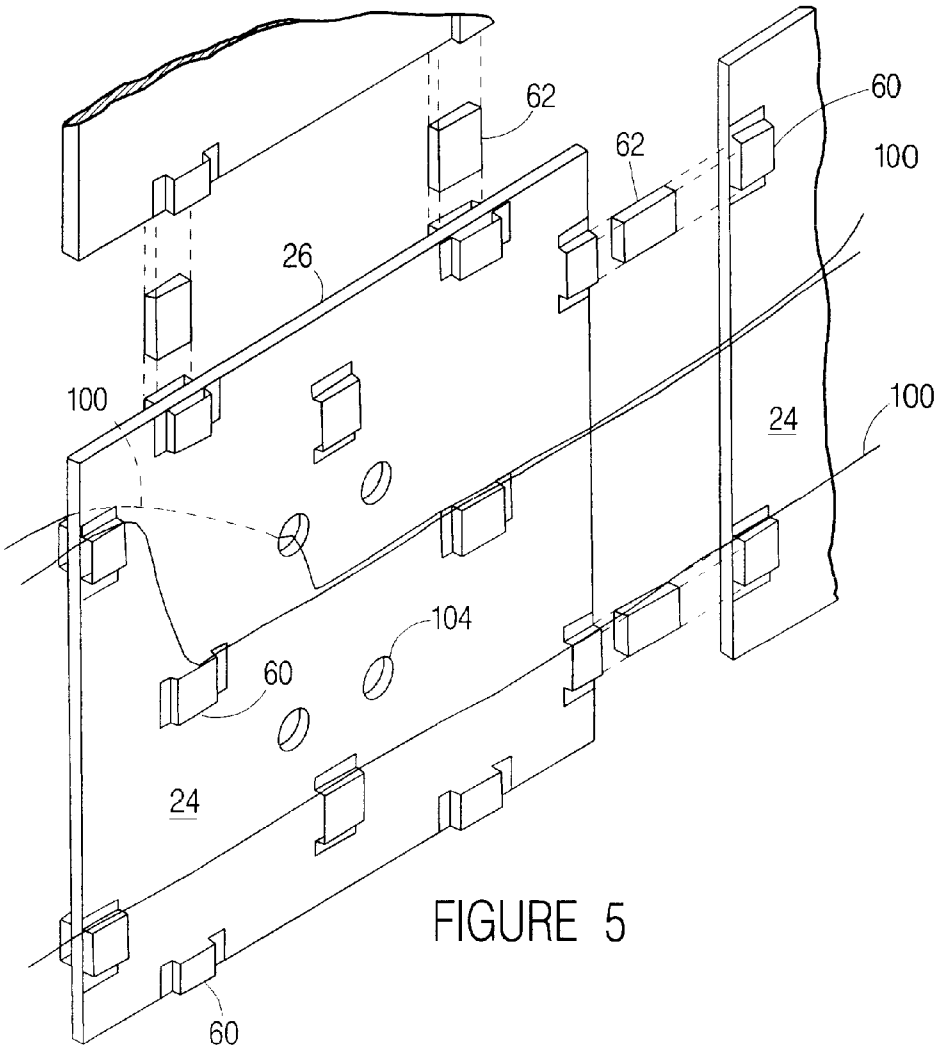
Figure 9:
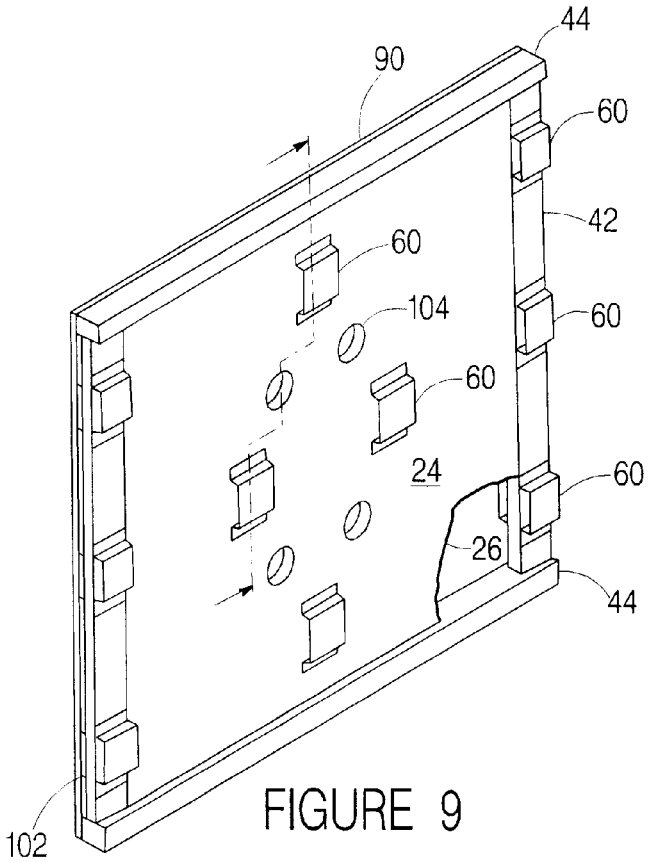
FIG. 9 is a perspective view of a panel section (with one covering skin attached) according to an alternative embodiment of the present invention.
Figure 10:
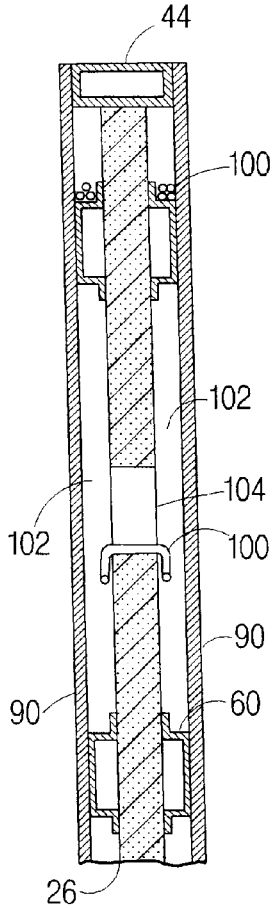
FIG. 10 is a sectional view of the panel section of FIG. 9 (with both covering skins attached) also showing a exemplary cable management arrangement.

FIG. 7 shows a partition wall system 10 including a plurality of interconnected panel sections 20 of the type shown in FIGS. 5 and 6 (with a portion broken away to illustrate the eight adjacent brackets 60 associated with four panel sections 20). FIGS. 5 and 6 are similar, showing the use of links 62 to interconnect panel sections 20 (shown with the covering skins removed), with FIG. 6 also illustrating exemplary passages of cables 100 across a panel section 20. As shown, brackets 60 mounted in the central area of solid core of panel section 20, provide the capability to guide cables 100 passing across panel section 20. FIGS. 5 and 6 also illustrate that the solid core 26 of panel section 20 can be provided with one or more apertures (holes 104) allowing cables 100 to be passed through from one side to the other side of the panel section 20. FIG. 8 illustrates how brackets 60 provide a space 102 between base surface 24 of panel section 20 and the inner surface of the covering skins 90 (shown in phantom lines). FIGS. 9 and 10 show a panel section 20 including both a solid core 26 to which brackets 60 are attached and a frame of vertical posts 42 and horizontal beams 44, to which brackets 60 are also attached, providing passages 102 for cables 100 through the panel section 20 when covering skins 90 are attached.

Referring to FIGS. 13 through 29, additional alternative embodiments of a panel section for the partition wall system are shown. According to particularly preferred embodiments, shown in FIGS. 13 through 16, and 32 and 33, panel section 20 includes a wall (shown as a sheet 22) into which corrugations 30 are formed (by stamping or the like). As is known of those of skill in the art of metalworking, the type and thickness of the metal sheet can be varied according to various cost and performance criteria. According to alternative embodiments, the walls can be made of a sheet of another type of material (such as a plastic, sheet-molding compound, resin, resin-rich fabric, fiber, composite, fiber-reinforced plastic) which can be formed by extrusion, pultrusion, vacuum forming, pressure forming, injection molding, blow molding or the like. In any preferred embodiment, the sheet (or sheets) which forms the wall (or walls) will be of a material of suitable strength to provide both for a suitably rigid panel section (at least when constructed into the partition wall system) and for attachment of covering skins.

Figure 15:
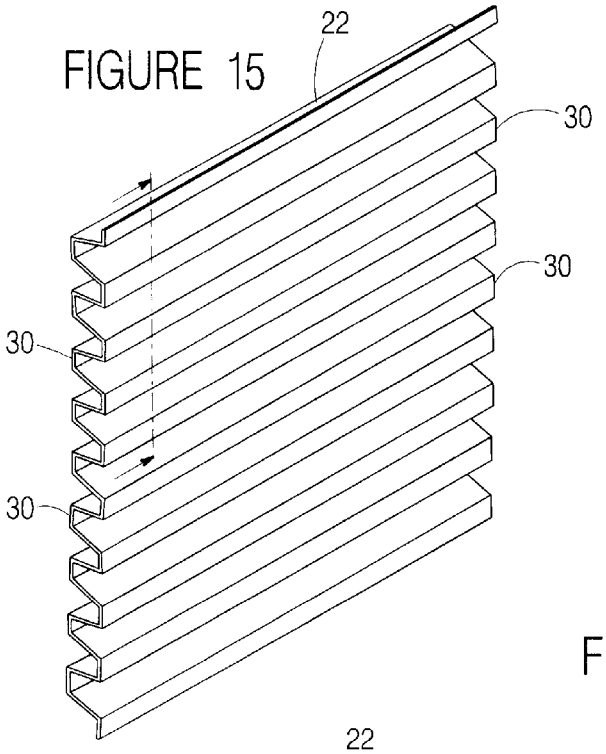
FIG. 15 is a perspective view of a panel section (with one covering skin attached) according to an alternative embodiment of the present invention.
Figure 16:
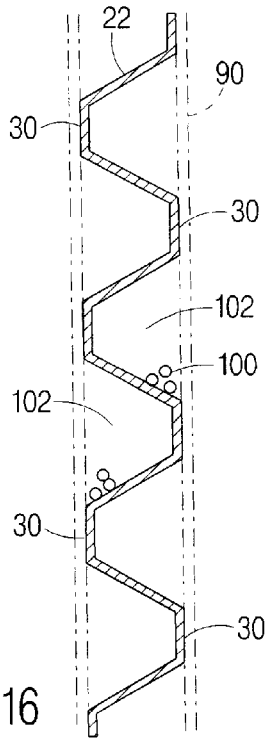
FIG. 16 is a sectional view of the panel section of FIG. 15 (with covering skins shown in phantom lines) also showing an exemplary cable management arrangement.

Corrugations 30 are in effect alternating rows of protrusions and depressions. (As is evident, the depression on one side of corrugated wall is the protrusion on the other side of corrugated wall.) Corrugations can provide a fully or partially curved or rectilinear (as shown) or any other shape of profile. As shown in FIGS. 15 and 16, panel section 20 consists essentially of rigid corrugated wall 22, to which covering skins 90 (shown by phantom lines) can be attached directly. The attachment of covering skins 90 may further rigidify panel section 20.

Figure 17:
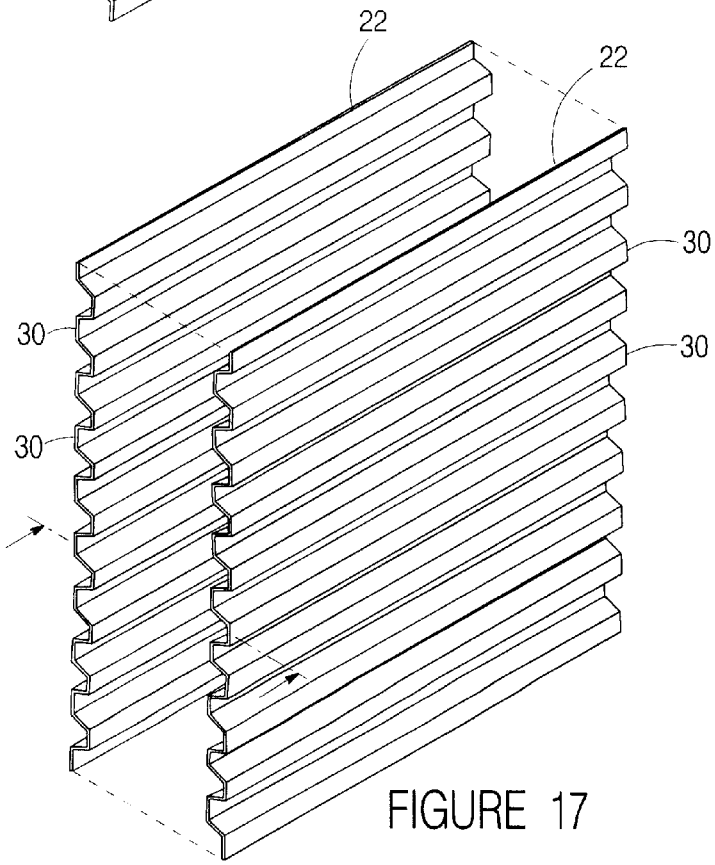
FIG. 17 is a perspective view of a panel section (with one covering skin attached) according to an alternative embodiment of the present invention.
Figure 18:
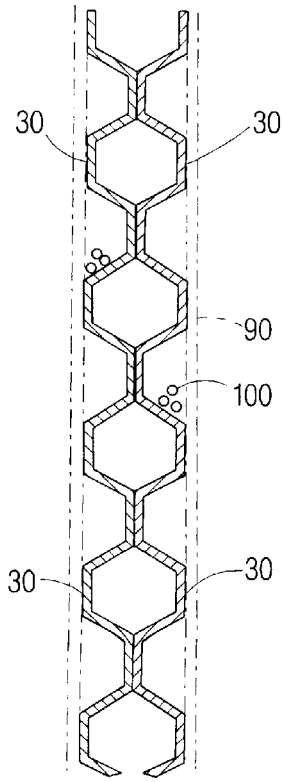
FIG. 18 is a sectional view of the panel section of FIG. 17 (with covering skins shown in phantom lines) also showing an exemplary cable management arrangement.
Figure 26:
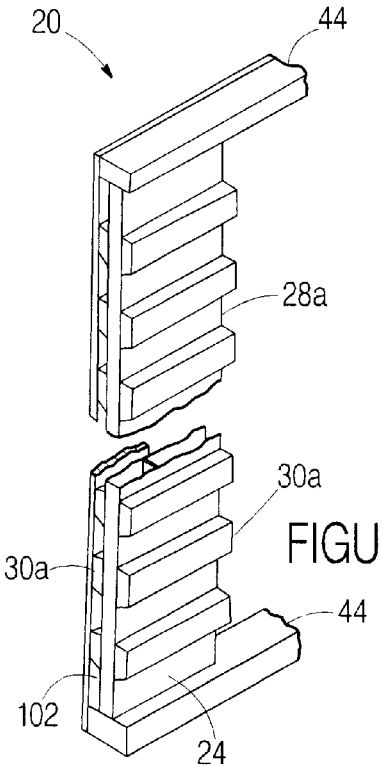
FIGS. 26 and 27 are fragmentary perspective views of panel sections according to alternative embodiments of the present invention.
Figure 27:
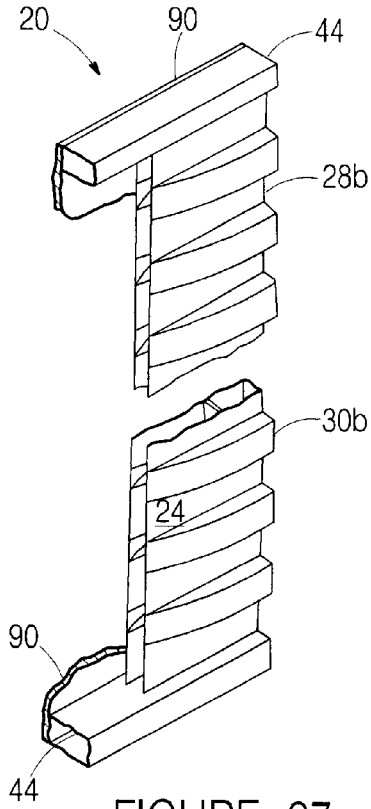
Figure 28:
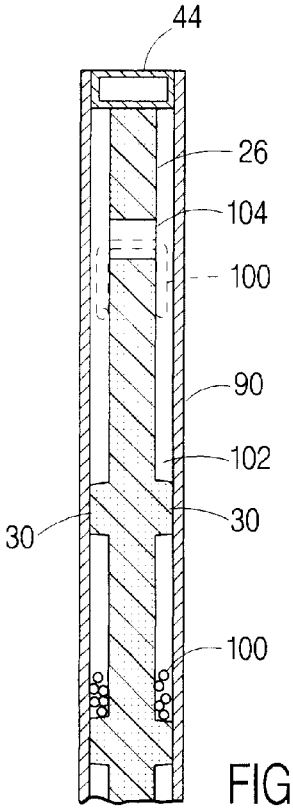
FIG. 28 is a sectional view of a panel section (with both covering skins attached) according to an alternative embodiment of the present invention also showing an exemplary cable management arrangement.
Figure 29:
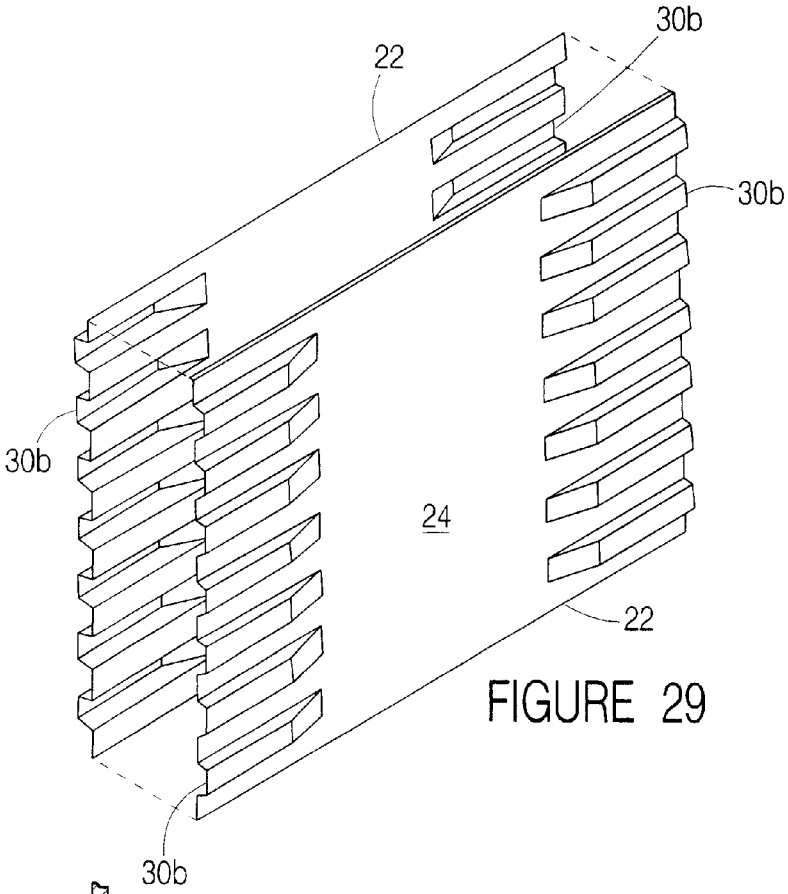
FIG. 29 is an exploded perspective view of a panel section according to an alternative embodiment of the present invention.

According to other embodiments shown in FIGS. 17 through 18 and 29, panel section 20 includes a pair of walls (shown as sheets 22), which may tend further to rigidity or reinforce the structural integrity of the panel section. In FIGS. 17 through 18, corrugations of each wall are configured so that the depressions of each wall abut at the center of the panel section. Abutting corrugations 30 of each wall 22 may be secured together by one or more fasteners (such as rivets) or by welds. The panel sections may thus be constructed with the corresponding walls themselves providing the necessary structure (i.e. without requiring any supplementary structure such as posts or beams). Covering skins 90 (shown in phantom lines in FIGS. 16 and 18) may provide supplemental rigidification to panel sections 20. As shown in FIGS. 26 and 27, walls 22 may have corrugations (shown as rectangular protrusions 30a in FIG. 26 and as wedges 30b in FIG. 27) that extend only partially across panel section 20. According to alternative embodiments, the walls can be provided as separate sheets or strips of materials from the vertical posts that securely attach within the interior of the panel section, for example spanning between horizontal posts. While the walls of the panel section are asymmetrical as shown, according to alternative embodiments asymmetrical walls can be used.

Figure 14:
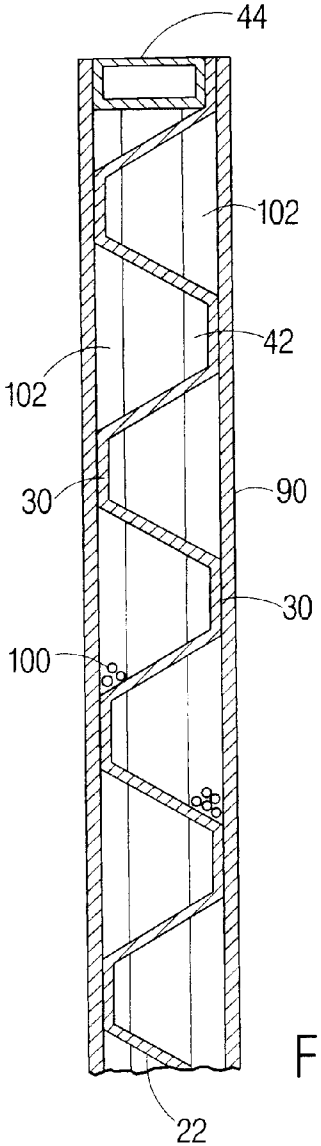
FIG. 14 is a sectional view of the panel section of FIG. 13 (with both covering skins attached) also showing an exemplary cable management arrangement.
Figure 13:
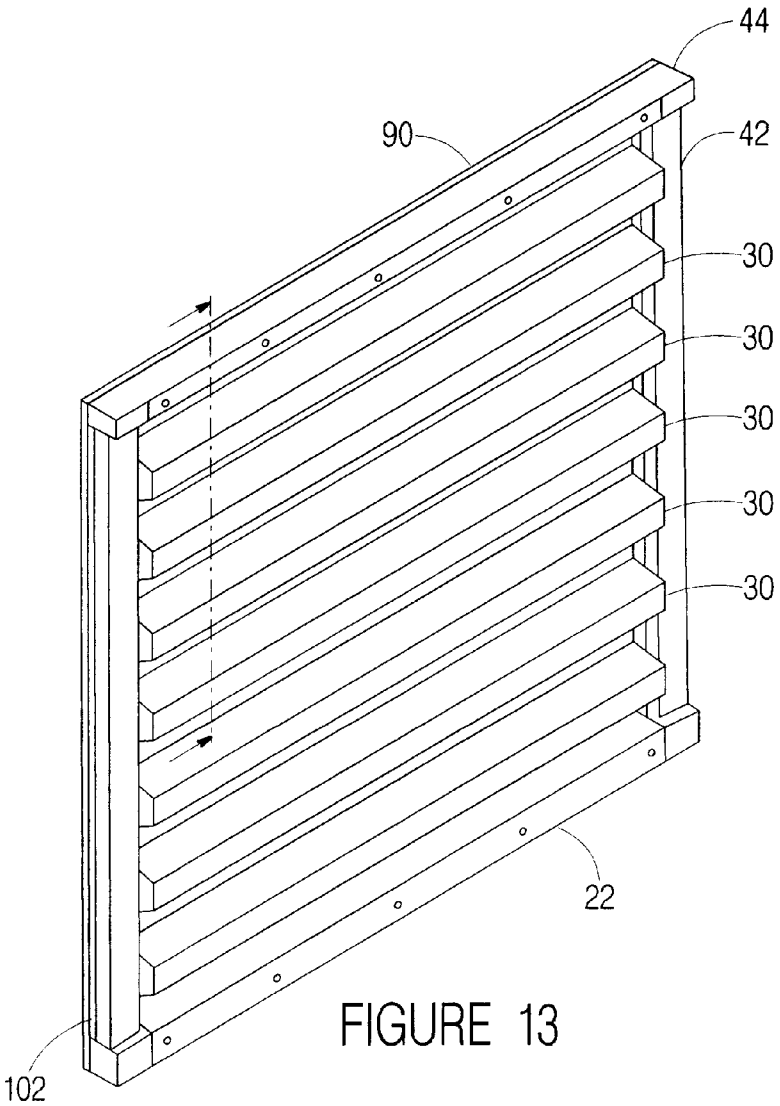
FIG. 13 is a perspective view of a panel section (with one covering skin attached) according to an alternative embodiment of the present invention.
Figure 19:
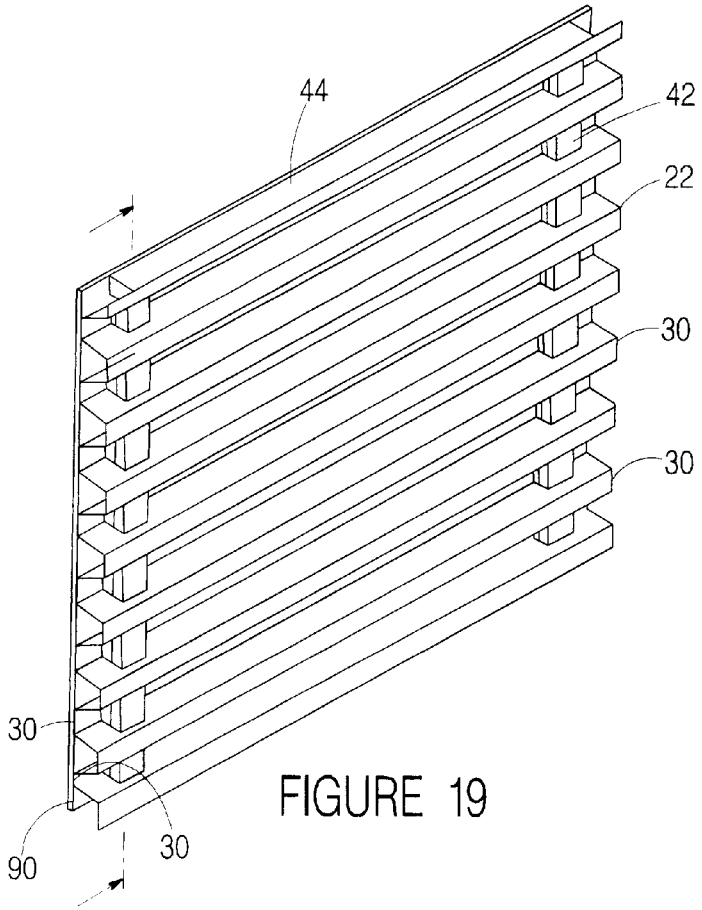
FIG. 19 is a perspective view of a panel section (with one covering skin attached) according to an alternative embodiment of the present invention.
Figure 20:
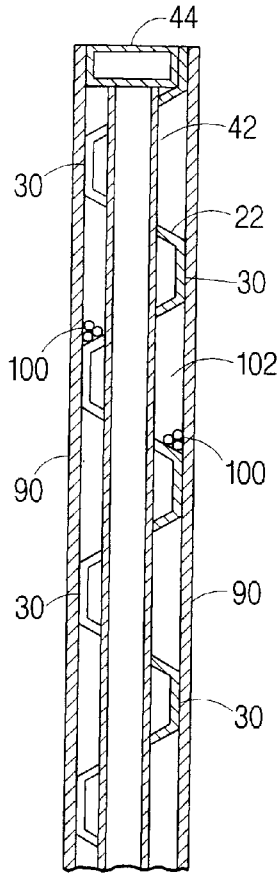
FIG. 20 is a sectional view of the panel section of FIG. 19 (with both covering skins attached) also showing an exemplary cable management arrangement.
Figure 21:
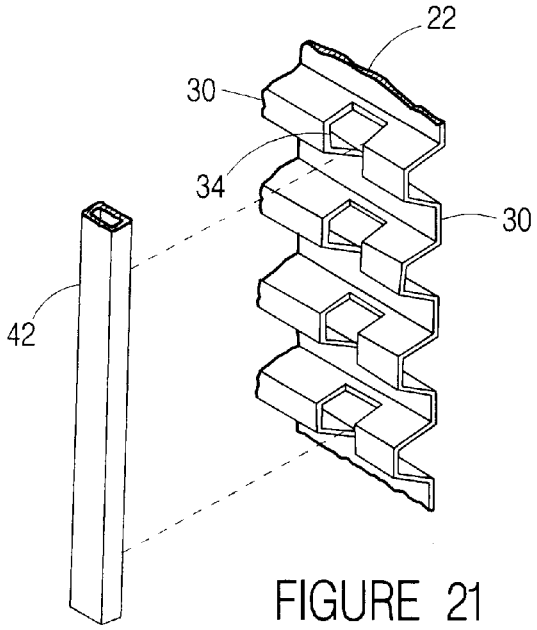
FIG. 21 is a fragmentary perspective view of the panel section of FIGS. 19 and 20.

According to alternative embodiments shown in FIGS. 13 and 14 and 19 through 25, the panel section may be structurally reinforced. As shown in FIGS. 13 and 14, the reinforcement employs a set of vertical posts 42 and horizontal beams 44 in a frame to which corrugated wall 22 can be attached (i.e. by welding or the like or by fasteners shown as screws 68). Each of post 42 and beam 44 is formed as a hollow metal tube (shown with a rectangular shape), welded together to form the frame for an integrated panel section 20. FIGS. 19 through 21 show a panel section where the vertical posts 42 and horizontal beams 44 are integrated within corrugated wall 22 (in cutouts 34) to form rigid panel section 20. The frame (i.e. attached posts 42 and beams 44) is attached to corrugated wall 22 (in cutouts 34) by welding or fasteners (or the like). Covering skins 90 can be attached to both corrugated wall 22 and to posts 42 or beams 44 of the frame. As shown, in the preferred embodiments, covering skins 90 attach to panel section 20 on the flat leading edge of protrusions 30; a space 102 for cables 100 is therefore provided on either side of panel section 20 between the outer surfaces of walls 22 and the inner surfaces of covering skins 90.

As shown in FIGS. 13 through 29, a wide variety of shapes and arrangements of walls (with or without associated structures) may be employed in the construction of a panel section in a partition wall system that flexibly provides for cable management and lay-in capability. As is evident, any preferred embodiment of the partition wall system includes panel sections and covering skins in an arrangement that creates an at least partially contiguous set of passages (shown as spaces 102) allowing for cables (shown as wires 100) to be contained and routed therethrough. Apertures 104 of any shape may be provided in panel section 20. Panel sections 33 comprising corrugated walls 22, form spaces in the manner of distinct or segregated horizontal passages 102 across the panel section. As shown in FIGS. 24, 25 and 29, the corrugations 30b may be only partial in length across wall 22.

As shown in FIGS. 24 and 25, a panel section 20 can be formed of corrugated walls 22 into a partially hollow but sufficiently rigid structure. Hollow inner areas 105 of panel section 20 may be left open or filled with a material intended to provide for structural reinforcement or attenuation of sound (or some other purpose known to those of skill in the art who review this disclosure). Similarly, as shown in FIGS. 5 through 12 and 28, a panel section 20 can be constructed of solid core 26 formed with protrusions 30 (stand-offs of some suitable shape) attached thereto. According to various embodiments, the solid core can be a wood or wood composite or a foam or other composite material (although a wide variety of other materials may also be used). See for example U.S. Pat. No. 2,241,338 and U.S. Pat. No. 4,423,573, which are incorporated by reference herein. If the solid core provides sufficient structure and strength for mounting the covering skins, and forming the rigid panel section for use in the partition wall system, then it may not be necessary to provide a supplemental structure (shown in FIGS. 9 and 10 as vertical posts 42 and horizontal beams 44).

According to the alternative embodiment shown in FIGS. 26 and 27, a panel section 20 (shown partially) may be constructed with an open center portion between horizontal beams 44 and vertical posts 42 (and between the covering skins). Integrated with vertical posts 42 are partial walls (28*a* or 28*b*) having elongate protrusions, shown as rectangular blocks 30*a* in FIG. 26 and as wedges 30*b* in FIG. 27, which allow attachment of covering skins 90 and define spaces 102 between covering skins 90 and the base surfaces 24 of partial walls (28*a* or 28*b*) for passage of cables 100 (not shown). The open central portion of panel section 20 freely provides for cable management in any direction between covering skins 90. As is also evident, according to alternative embodiments the panel section 20 can be constructed to provide for cable passages 102 (i.e. lay-in capability) on one side only of wall 22.

Figure 32:
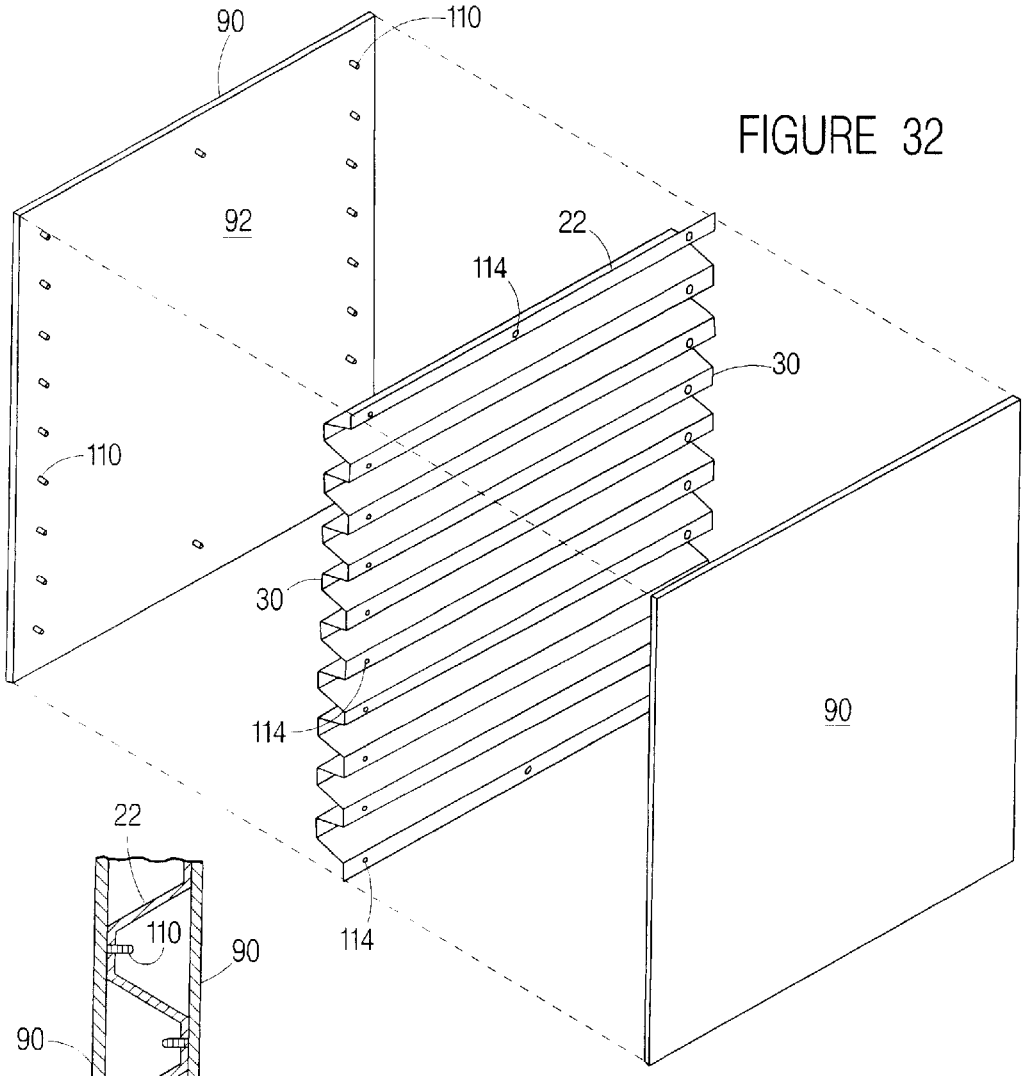
FIG. 32 is an exploded perspective view of a panel section (showing the attachment of covering skins) according to an alternative embodiment of the present invention.
Figure 33:
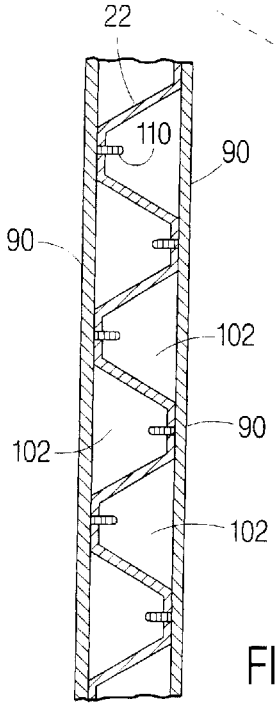
FIG. 33 is a sectional view of the panel section of FIG. 32 (with both covering skins attached).

FIGS. 32 and 33 illustrate a particularly preferred embodiment wherein covering skins 90 are provided with a plurality of inwardly projecting mounting pins 110 which are securely received and retained within corresponding aligned apertures 114 on or along at least certain of corrugations 30 of wall 22 of panel section 20. As shown in FIGS. 30 and 31, mounting pins 110 have a series of concentrically-aligned conical locking detents 112 which provide for an overall effective outer diameter of the mounting pin 110 greater than the diameter of corresponding aperture 114. Mounting pins 110 are made of a compliant (e.g. deformable plastic or like resilient) material and can be pressed under force within aperture and thereby retained by one of the detents against a "pull-out" force (up to a certain threshold value) required to deform and thereby remove mounting pin 110 from corresponding aperture 114. Once pressed into the corresponding aperture 114, the mounting pins 110 will provide a locking and holding effect. According to alternative embodiments, the arrangement of apertures and mounting pins on protrusions and covering skins can be reversed, or other arrangements for securing covering skins to panel sections can be employed. By employing more of the mounting pins, a greater overall holding force or more secure attachment can be provided for the covering skins.

Figure 35:
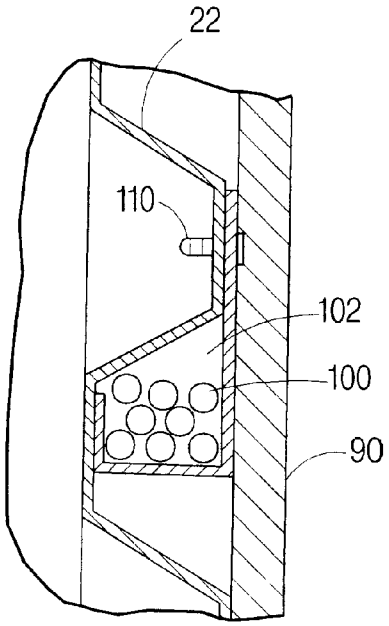
FIG. 35 is a fragmentary side view of the panel section (with covering skin attached) showing the cable tray of FIG. 34.
Figure 34:
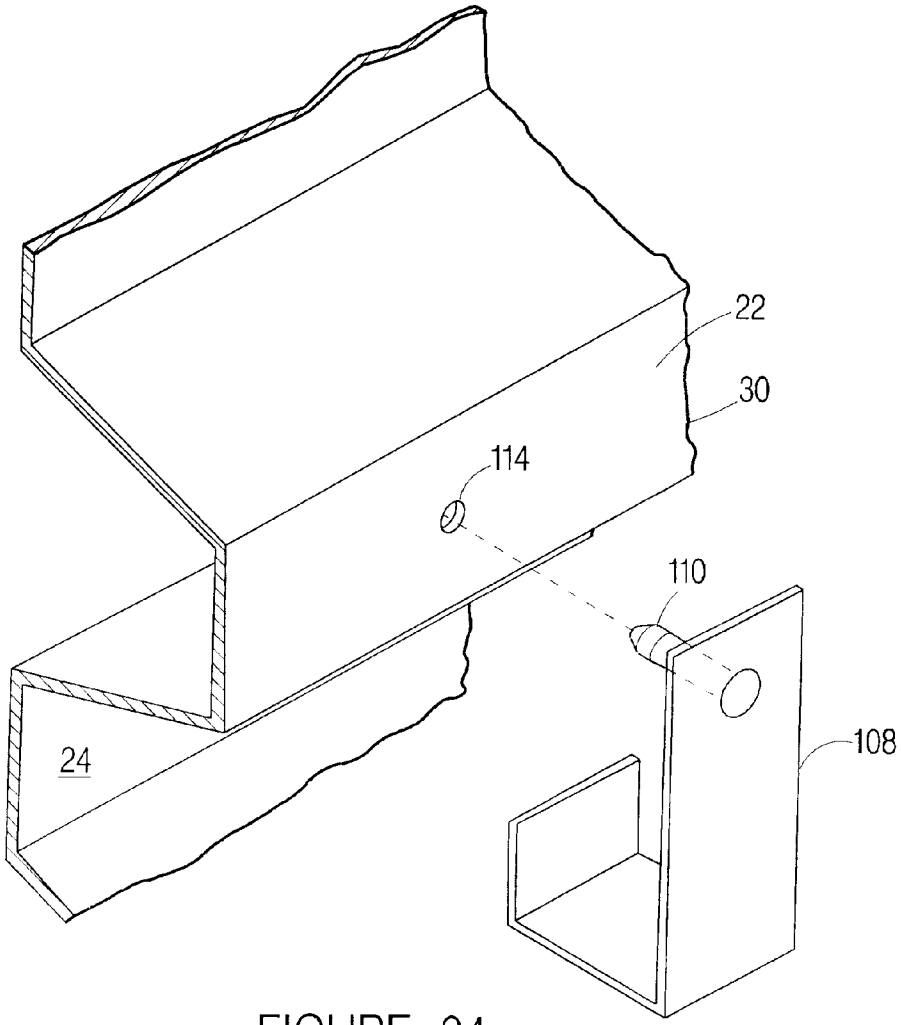
FIG. 34 is a fragmentary perspective view of a panel section showing a cable tray according to a preferred embodiment of the present invention.

FIGS. 34 and 35 show cable management accessories for use with the partition wall system according to a preferred embodiment. A cable retainer in the form of retaining plate or retaining tray 108 (or some other structure or hook of similar capability) can be secured to one or more corrugations 30 in the panel section 20. As shown, the cable retainer can be attached to the panel section by a mounting pin 110 (of a type shown in FIGS. 30 and 31) or by any other fastening or mounting arrangement. As shown in FIG. 35, a retaining tray 108 will hold cables 100 beneath protrusion 30 in the cable lay-in space 102 provided between the base surface 24 of wall 22 and covering skin 90. According to an alternative embodiment, a retaining plate (not shown) may hold cables above the corrugation in the cable lay-in space provided between the base surface of wall and covering skin.

According to alternative embodiments, the panel sections may be interconnected in a wide variety of other arrangements known to those of skill in the art who review this disclosure. For example, the frame of each panel section may be provided with a supplementary attachment structure (such as a bracket) at its lateral ends that attaches to a mounting post, which can interconnect panel sections in various angular orientations. As another example, the frame of each panel section may be formed with integral slots at one lateral end which engage projections formed in the corresponding lateral end of the adjacent panel section successively to interconnect panel sections into a partition wall system. These examples are provided by way of example only and are not intended to limit the scope of the present invention. According to any preferred embodiment, the panel sections can be interconnected both laterally and in a secure "stacked" fashion to form the partition wall system.

Various exemplary arrangements for interconnecting panel sections are disclosed in U.S. Pat. No. 5,426,904, U.S. Pat. No. 5,377,466, U.S. Pat. No. 5,134,826, U.S. Pat. No. 5,117,599, U.S. Pat. No. 5,038,534 and U.S. Pat. No. 4,567,698, which are incorporated by reference herein.

Although only a few exemplary embodiments of this invention have been described in detail above, those skilled in the art will readily appreciate that many modifications are possible in the exemplary embodiments without materially departing from the novel teachings and advantages of this invention. It is readily apparent that panel sections constructed according to the present invention can be made in any of a wide variety of shapes, sizes and thicknesses, with a wide variety of weights and strengths, and can be incorporated into a wide variety of partition wall systems with a wide variety of types of covering skins or interconnection and cable management arrangements. Accordingly, all such modifications are intended to be included within the scope of the invention as defined in the appended claims. In the claims, any means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

What is claimed is:

1. A partition wall system for use in a work environment, including a plurality of cables providing for at least one of electrical connectivity or data connectivity, the partition wall system comprising:

a plurality of interconnected panel sections;

a plurality of panel frames, each frame comprising a set of generally horizontal members and a set of generally vertical members and defining a first facing side and a second facing side, wherein the set of horizontal members are generally coplanar with the set of vertical members;

a plurality of brackets coupled to and offset from the panel frame;

a plurality of covering panels adapted for attachment on at least one of the first facing side or the second facing side of the panel frame;

wherein at least one of the plurality of brackets is adapted to provide for (a) the interconnection of one of the plurality of panel frames to at least one other of the plurality of panel frames (b) attachment of at least one of the plurality of covering panels to the panel frame and (c) the formation of a substantially continuous passage within the panel section to allow cables to selectively be routed between the panel frame and each covering panel.

2. The partition wall system of claim 1 wherein at least one of the plurality of brackets provides a generally orthogonal channel.

3. The partition wall system of claim 1 wherein at least one of the plurality of brackets includes a base section and a mounting tab.

4. The partition wall system of claim 1 wherein the base section provides a mounting surface for coupling to the covering panel.

5. The partition wall system of claim 1 wherein the set of horizontal members comprises at least one horizontal member and the set of vertical members comprises at least one vertical member.

6. The partition wall system of claim 5 wherein at least one of the plurality of brackets is attached to at least one horizontal member.

7. The partition wall system of claim 5 wherein at least one of the plurality of brackets is attached to at least one horizontal member and at least one of the plurality of brackets is attached to at least one vertical member.

8. The partition wall system of claim 1 further comprising a link adapted to provide for the interconnection of one of the plurality of panel frames to at least one other of the plurality of panel frames.

9. The partition wall system of claim 8 wherein the link is configured for at least partial insertion into at least one of the plurality of brackets.

10. The partition wall system of claim 9 wherein the link has a generally orthogonal shape.

11. The partition wall system of claim 1 wherein the covering panel is a skin.

12. The partition wall system of claim 1 wherein the covering panel is a tile.

13. A partition wall system for use in an interior space of a work environment, the partition wall system providing for lay-in of a plurality of generally flexible cables for at least one of electrical connectivity or data connectivity, the partition wall system comprising:

a panel section defining a first face and a second face;

a plurality of generally orthogonal panel frames providing a first facing surface and a second facing surface;

a core having a first surface and a second surface, wherein the first surface of the core is generally coplanar with the first facing surface of the panel frame;

a plurality of separately-formed brackets;

a plurality of covering panels adapted to be coupled to each panel frame;

wherein at least one of the plurality of brackets is configured both to provide for the interconnection of the panel sections and to form a substantially continuous passage to allow passage of cables within an interior space of the panel sections between the panel frame and the covering panels.

14. The partition wall system of claim 13 wherein at least one of the plurality of brackets includes a channel.

15. The partition wall system of claim 14 wherein at least four of the plurality of brackets are mounted on each facing surface of the panel frame.

16. The partition wall system of claim 13 wherein at least one of the plurality of covering panels includes a mounting surface for attachment to at least one of the plurality of brackets.

17. The partition wall system of claim 13 further comprising a link configured for at least partial insertion within at least one of the plurality of brackets.

18. The partition wall system of claim 13 wherein the core is substantially solid.

19. The partition wall system of claim 13 further comprising an aperture in the core for routing cables.

20. The partition wall system of claim 13 wherein the covering panel is a tile.

21. The partition wall system of claim 20 wherein the tile is a skin.

22. A panel section for a partition wall system for use in a work environment, the work environment providing electrical or data sources, the partition wall system adapted to provide for lay-in of a plurality of cables providing for at least one of electrical connectivity or data connectivity, the panel section comprising:

a panel frame having a set of horizontal members and a set of vertical members, wherein the set of horizontal members are generally coplanar with the set of vertical members and the horizontal members and the vertical members are rigidly coupled to define a first base surface on one side of the frame and a second base surface on the other side of the frame;

a plurality of separately-formed standoffs, at least two of the plurality of standoffs attached on the first base surface of the frame and at least two of the plurality of standoffs attached on the second base surface of the frame;

a plurality of tiles adapted for attachment to the at least two standoffs on the first base surface and the second base surface of the frame;

a utility block adapted for coupling to at least one of the plurality of standoffs;

wherein at least one of the plurality of standoffs is mounted to at least one vertical member and at least one of the plurality of standoffs is mounted to at least one horizontal member so that the panel frame can be interconnected to another panel frame in at least one of a vertical direction or a horizontal direction;

and wherein at least one of the plurality of tiles is coupled to at least one of the plurality of standoffs so that a substantially continuous passage to allow cables to travel through is formed between the panel frame and each tile.

23. The panel section of claim 22 wherein at least one of the plurality of standoffs is a bracket.

24. The panel section of claim 22 wherein at least one of the plurality of standoffs provides a surface to mount the tile.

25. The panel section of claim 22 wherein at least one of the plurality of standoffs is configured to guide cables.

26. The panel section of claim 25 wherein at least one of the plurality of standoffs is configured for attachment of an accessory.

27. The panel section of claim 22 wherein the standoff is configured to guide cables.

28. The panel section of claim 22 wherein at least one panel section comprises at least two panel frames.

29. The panel section of claim 28 further comprising a plurality of generally horizontal members and generally vertical members for rigidifying the base surface.

30. The panel section of claim 28 wherein at least one of the standoffs is mounted to the utility block.

31. The partition wall system of claim 28 wherein the tile is a covering panel.

32. The partition wall system of claim 31 wherein the tile is a covering skin.

33. The partition wall system of claim 32 wherein the utility block comprises at least one of a switch, network equipment, telephony equipment, a sensor, and combinations thereof.

34. The partition wall system of claim 32 wherein the utility block includes a mounting structure for attachment to the standoff.

35. A partition wall system for use in a work environment, including a plurality of cables providing for at least one of electrical connectivity or data connectivity, the partition wall system comprising:

a plurality of interconnected panel sections, each panel section having a panel frame defining a first facing side and a second facing side and a plurality of brackets coupled to and offset from the panel frame;

a plurality of covering skins adapted for attachment on at least one of the first facing side or second facing side of the panel section;

a utility block providing at least one outlet and mounted within at least one of the plurality of brackets and adapted to be connected to at least one of the plurality of cables;

wherein at least one of the brackets is adapted both to provide for the interconnection of one of the plurality of panel frames to at least one other of the plurality of panel frames and to provide for attachment of at least one of the plurality of covering skins to the panel section so that a substantially continuous passage is formed within the panel section to allow at least one of the plurality of cables to selectively be routed between the panel frame and each covering skin.

36. The partition wall system of claim 35 wherein at least one of the plurality of brackets provides a channel.

37. The partition wall system of claim 36 wherein at least one of the plurality of brackets provides a mounting surface for attachment to at least one of the plurality of the covering skins.

38. The partition wall system of claim 35 wherein at least one of the plurality of brackets is a multi-purpose bracket.

39. The partition wall system of claim 35 wherein the frame includes a generally horizontal member and a generally vertical member.

40. The partition wall system of claim 39 wherein at least one of the plurality of brackets is attached to the horizontal member.

41. The partition wall system of claim 39 wherein the utility block comprises at least one of a switch, network equipment, telephony equipment, a sensor, and combinations thereof.

42. The partition wall system of claim 39 wherein the covering skin is a tile.

* * * * *